US005353539A

United States Patent [19]

Zeh

[11] Patent Number: 5,353,539

[45] Date of Patent: Oct. 11, 1994

[54] MOUNTING DEVICE FOR A TELESCOPIC SIGHT ON A RIFLE

[75] Inventor: Meinrad Zeh, Isny, Fed. Rep. of Germany

[73] Assignee: Horst blaser Jagdwaffenbarik, Isny, Fed. Rep. of Germany

[21] Appl. No.: 110,885

[22] Filed: Aug. 24, 1993

[30] Foreign Application Priority Data

Sep. 1, 1992 [DE] Fed. Rep. of Germany ... 9211742[U]

[51] Int. Cl.[5] ..... E41G 1/387

[52] U.S. Cl. ..... 42/101

[58] Field of Search ..... 42/100, 101, 102, 103

[56] References Cited

U.S. PATENT DOCUMENTS

| | | | |
|---|---|---|---|
| 2,803,907 | 8/1957 | Weaver | 42/101 |
| 3,491,975 | 1/1970 | Weaver | 42/101 |
| 4,574,508 | 3/1986 | Ross | 42/101 |

OTHER PUBLICATIONS

Catalogue "Zielfernrohrmontagen" [Telescopic sight mount] of the company Ernst Apel, Apr. 1988, p. 58.

*Primary Examiner*—David Brown

*Attorney, Agent, or Firm*—Flynn, Thiel, Boutell & Tanis

[57] ABSTRACT

The mounting device for a telescopic sight on a rifle comprises a mounting bridge (5) which carries a holder (6) for the telescopic sight and on one side at each of the front and the rear ends a fixed jaw (10) and on the opposite side two movable jaws (14) movable transverse to the mounting bridge (5). The receiver (2) of the barrel comprises two blind bores (3) running substantially radially relative to the barrel axis and offset from one another in the direction of the barrel axis (A). Opposite each blind bore (3), on the other side of the barrel, there is provided an approximately half-moon shaped notch (4), the bottom surface (4*a*) of which running in the barrel direction forms a clamping surface for a movable jaw (13, 14). The two fixed jaws (10)each comprise a cylindrical retaining pin (11) which fits in one of the blind bores (3). Each movable jaw consists of a pivoting lever (13) with a locking nose (14). The pivoting lever (13) is fixedly connected to a threaded pin (15), which is axially movable in a bore (16) in the mounting bridge (5) running substantially tangentially to the peripheral surface of the receiver (2) and can be screwed into a nut (17) fixed in the mounting bridge (5).

7 Claims, 2 Drawing Sheets

A
B
C
1
2
4
5
6
7
8
9
12
13
14
III
III

MOUNTING DEVICE FOR A TELESCOPIC SIGHT ON A RIFLE

FIELD OF THE INVENTION

This invention relates to a mounting device for a telescopic sight on a rifle, comprising a mounting bridge which carries a holder for the telescopic sight and on one side, at each of the front and the rear ends, a fixed jaw and, on the opposite side, at least one movable jaw movable transverse to a longitudinal central plane running through the mounting bridge and the barrel axis by means of a rotatable operating handle and a threaded pin engaging in a nut, and a plurality of clamping surfaces provided on the receiver of the barrel, extending at an angle to the longitudinal central plane and on which the jaws engage in the mounted position.

BACKGROUND OF THE INVENTION

In one such known mounting device (cf. catalogue "Zielfemrohrmontage" [Telescopic sight mount] of the company Ernst Apel, W-8708 Gerbrunn-Würzburg, April 1988, page 58), the two fixed jaws have dovetail formed undercuts. The receiver itself is provided with a prism running in the barrel direction, whose dovetail form, undercut side surfaces form the clamping surfaces for the jaws. The telescopic sight is normally screwed fast to the mounting bridge, as usual. To mount the telescopic sight on the rifle the mounting bridge is brought into abutment with its two fixed jaws in abutment with one of the side faces of the prism and it is then tilted towards the rifle about an axis running parallel to the barrel axis, whereby the movable jaws move into the region of the other side surface of the prism. At the same time as the tilting movement, a fixing pin on the underside of the mounting bridge comes into engagement with a transverse groove provided in the prism. This fixing pin serves to transfer the forces in the barrel direction from the receiver to the mounting bridge and vice versa. After the mounting bridge has been tilted on the prism of the receiver (this known mounting device is accordingly known as a "tilt mount"), the nut is actuated and the movable, undercut jaw is thereby clamped against the other side of the prism. In this known mounting device, the movable jaw is in the middle between the two fixed jaws, whereby a 3-point support of the mounting bridge on the receiver is effected. However, the manufacture of the dovetail form undercut clamping surfaces on the prism of the receiver requires substantial expense, since these surfaces must be precisely parallel to one another and to the barrel axis. Moreover it is necessary in forming the prism to provide an upwardly extending extension on the receiver, since the receiver would otherwise be too greatly weakened by the dovetail form undercutting extending over the whole length thereof in the region of the cartridge chamber. Additional weight results from the upwardly projecting extension and the telescopic sight axis moreover assumes a greater distance from the barrel axis. The fixing pin, which has to be separately made and attached to the mounting bridge, as well as the transverse groove for its engagement in the prism require additional working steps in the manufacture. The 3-point support of the mounting bridge on the prism is not particularly stable, so that the known mounting device is only suitable for small, light telescopic sights. Moreover the 3-point support has the disadvantage that the mounting bridge can move during the tightening of the movable jaw, so that an aiming point offset can arise.

SUMMARY OF THE INVENTION

The invention is therefore based on the object of providing a mounting device for a telescopic sight on a rifle of the kind initially referred to, which is simple to make and is particularly stable and in which the aiming point is not altered even with repeated removal and fitting of the telescopic sight on the rifle.

This is achieved in accordance with the invention in that the clamping surfaces on one side of the barrel are formed by two blind bores running substantially radially relative to the barrel axis and offset from one another in the direction of the barrel axis, and in that opposite each blind bore, on the other side of the barrel, there is provided an approximately half-moon shaped notch, the bottom surface of which running in the barrel direction forms a clamping surface for a movable jaw, in that the two fixed jaws each comprise a cylindrical retaining pin which fits in one of the blind bores, and in that each fixed jaw has associated therewith a movable jaw in the form of a locking nose provided on a pivoting lever, wherein the pivoting lever is fixedly connected to the threaded pin, which is axially movable in a bore in the mounting bridge running substantially tangentially to the peripheral surface of the receiver and can be screwed into a nut fixed in the mounting bridge.

In this design of the mounting device the clamping surfaces can be produced very simply on the receiver by means of numerical control techniques. The blind bores can be machined directly in the receiver in a short time and with high accuracy using suitable boring tools or end mills and likewise the two opposed notches. Since only a small part of the material of the receiver is removed by this at axially spaced locations, there is hardly any weakening of the receiver. As a result the receiver does not need any extension, so that it is lighter and the telescopic sight axis can moreover be arranged closer to the barrel axis. The costs of manufacture are also reduced in that the cylindrical pins serve at the same time to transfer the axially directed forces from the barrel to the mounting bridge and vice versa. Accordingly the costs of manufacturing and fitting a fixing pin and the transverse groove needed for this in the receiver disappear. The two cylindrical pins which can fit precisely in the blind bores also provide for positionally accurate fitting of the mounting bridge with high reproducibility. As a result the telescopic sight is always mounted accurately in position, even with repeated removal and refitting on the rifle, so that it is ensured that there is no displacement of the aiming point. Since an individual movable jaw is provided for each cylindrical pin, in the form of a locking nose provided on a pivoting lever, there is a very stable 4-point support and connection of the mounting bridge to the receiver, which also allows the use of a large and heavy telescopic sight.

BRIEF DESCRIPTION OF THE DRAWINGS

The invention is explained in more detail below with reference to an embodiment shown in the drawings, in which.

DETAILED DESCRIPTION

Figure 1:
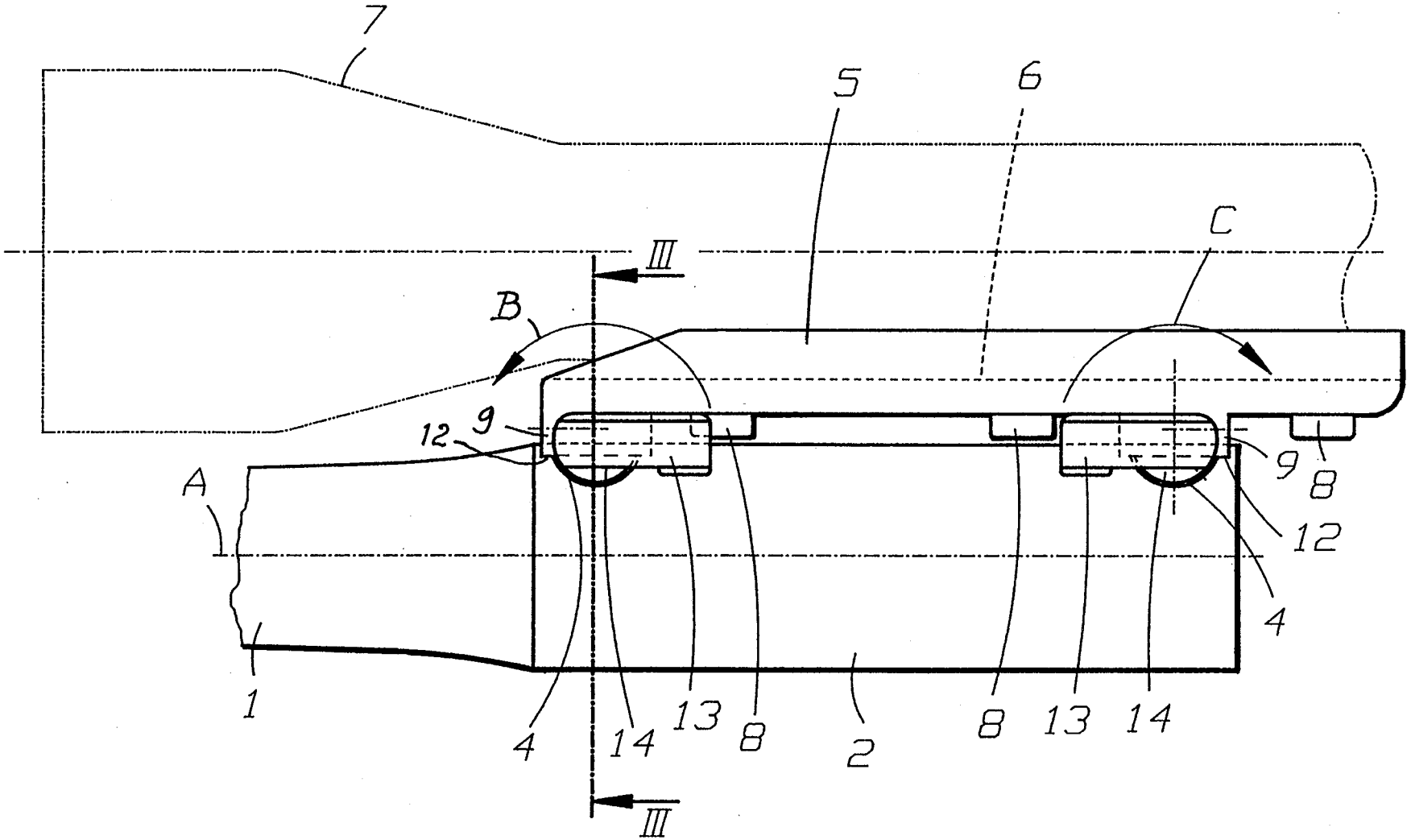
FIG. 1 is a side view of the receiver with mounting bridge clamped

In the drawing the barrel of a rifle is indicated at 1, having a receiver 2 at its rear end. This is preferably in one piece with the barrel. The barrel can however by screwed into the receiver 2. The receiver 2 has two blind bores 3 on one side of the barrel, these being offset from one another in the direction of the barrel axis A. These blind bores 3 run substantially radially to the barrel axis A. Opposite to each blind bore the receiver has an approximately half-moon shaped notch 4, whose bottom surface 4*a* running in the barrel direction forms a clamping surface for a movable clamping jaw described in more detail below. The axes a of the blind bores 3 make an acute angle $\mu$ with the plane E—E running through the bottom surfaces 4*a*, which amounts to approximately 50° to 70°, preferably 60°.

There is further provided a mounting bridge 5 extending substantially parallel to the barrel axis A. This mounting bridge 5 comprises a holder 6 for a. telescopic sight 7 on its side facing away from the barrel 1 or the barrel axis A. The holder preferably consists of a receiving groove 6 with a trapezoidal cross-section widening upwardly, i.e. away from the barrel axis A. This receiving groove 6 serves to receive a mounting shoe with corresponding cross-section connected fast to the telescopic sight 7. A plurality of nuts can be moved along in the longitudinal direction in the mounting shoe and fixing screws 8 can be screwed into these, being passed through suitable through bores in the mounting shoe 5. Any other known holder for a telescopic sight can be provided instead of the receiving groove 6 as the holder, e.g. two clamp tings or the like.

The mounting bridge 5 is provided at its front end and near its rear end with respective feet 9. Both feet 9 are of the same form, so that the description of one foot applies to the other. A fixed jaw 10 is arranged on each foot 9. The fixed jaw 10 comprises a cylindrical retaining pin 11, which fits in the blind bore 3. On the opposite side of the foot 9 from the fixed jaw 10 there is advantageously provided an abutment surface 12, with which the mounting bridge 5 or its foot 9 is supported on the peripheral surface of the receiver 2. Furthermore a pivoting lever 13 is associated there with each fixed jaw 10 and comprises a locking nose 14. The pivoting lever 13 together with the locking nose 14 forms a movable jaw. A threaded pin 15 is fixed to each pivoting lever 13 and is rotatably and axially movable in a bore 16 in the mounting bridge 5. The bore 16 runs substantially tangentially relative to the peripheral surface of the receiver 2. The threaded pin 15 is screwed into a nut 17, which is fixed in the mounting bridge 5. The nut can be provided with axially extending ribs or the like on its fixed head 17*a*, which engage in corresponding grooves in the mounting bridge. The nut is secured against rotation in this way. When needed however it can be taken out of its seat in the mounting bridge and be turned through a small angle, in order thereby to effect an adjustment of the clamping position of the pivoting lever 13.

Figure 2:
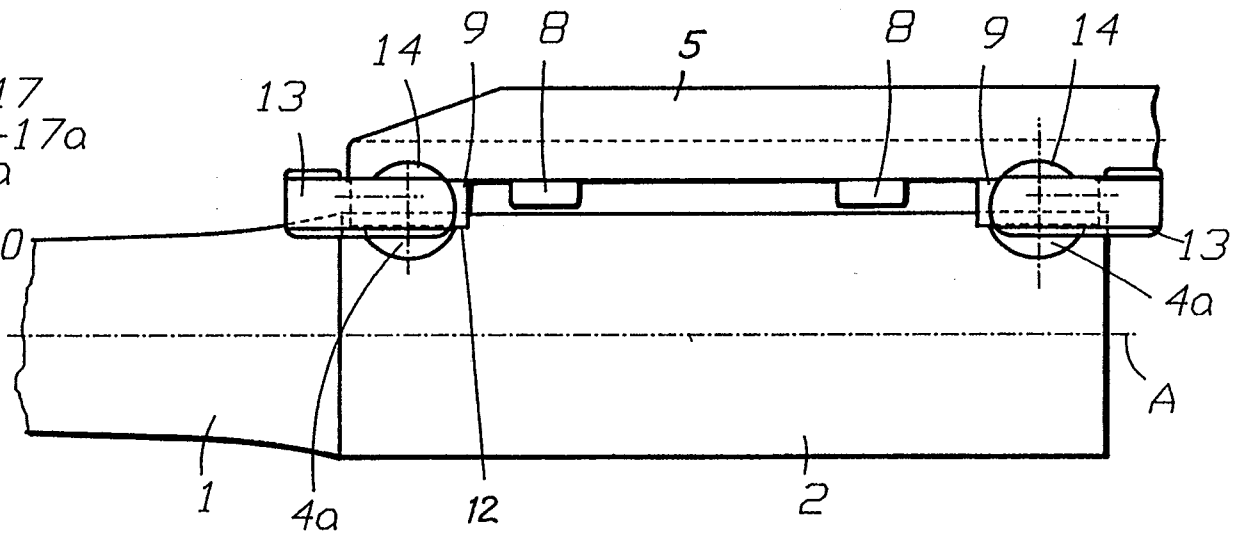
FIG. 2 is a similar side view with the mounting bridge released.
Figure 4:
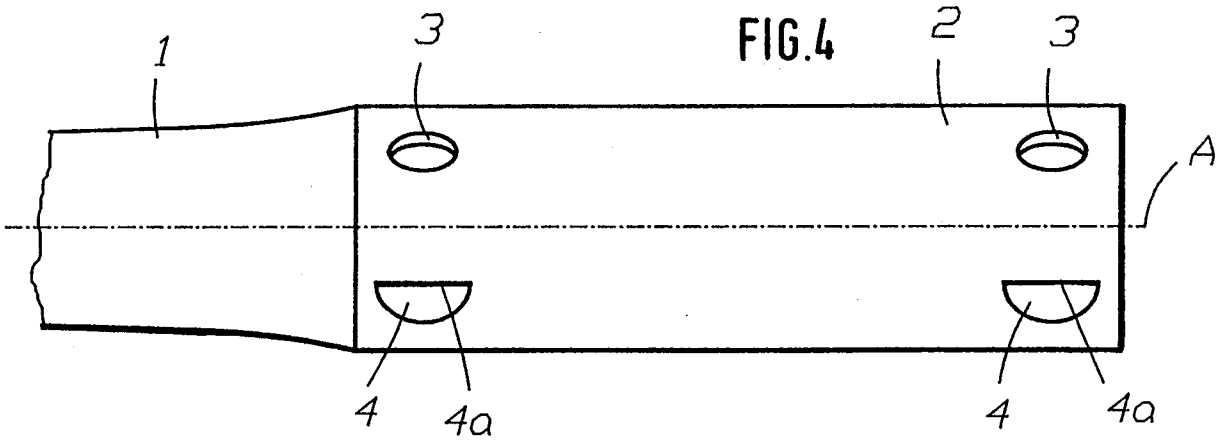
FIG. 4 is a plan view of the receiver without the mounting bridge.

The locking nose 14 is substantially cylindrical about the axis of the threaded pin 15. However, it comprises a flat 14*a* on one of its sides, which flat runs parallel to the barrel axis in the released position of the pivoting lever 13, as is shown in FIG. 2. In this manner, the locking nose 14 does not overlap the bottom surface 4*a* of the notch 4 in the released position of the pivoting lever 13.

The fixed jaws 10, their retaining pins 11 and the mounting bridge 5 are advantageously in one piece. This increases the stability and simplifies the manufacture.

Figure 3:
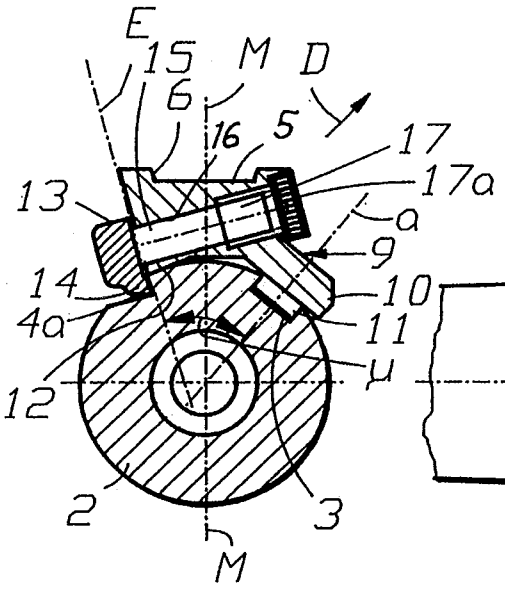
FIG. 3 is a cross-section on the line III—III of FIG. 1.

The mounting device is shown in FIGS. 1 and 3 in fitted and clamped position. The two cylindrical retaining pins 11 then engage in respective ones of the blind bores 3, the fixed jaw 10 bearing on the peripheral surface of the receiver 2. A further abutment occurs on the opposite side of the barrel, by way of the two abutment surfaces 12. By swinging the pivoting levers against the arrowed directions B and C in FIG. 1, the pivoting levers 13 are brought into their clamping position shown in FIG. 1. The threaded pin 15 of the pivoting lever 13 which is in front in the barrel direction and its associated nut 17 have right-handed threads while the threaded pin 15 of the rear, right pivoting lever 13 has a left-handed thread. By swinging the two pivoting levers against the respective directions B and C, their locking noses 14 are clamped fast against the bottom surfaces 4*a*. Since the bottom surfaces 4*a* and the cylindrical bore walls of the blind bores 3 run at an acute angle to a longitudinal central plane M—M running through the mounting bridge 5 and the barrel axis A, forces directed radially inwardly relative to the barrel axis A also result from the clamping, whereby the jaws 10 and also the abutment surfaces 13 are pressed firmly against the peripheral surface of the receiver 2. The mounting bridge 5 is in this manner always aligned accurately in position relative to the receiver 2 or the barrel axis with each fresh mounting.

In order to release the mounting device 5 and the telescopic sight 7 from the barrel, the two pivoting levers 13 are swung in the direction of the arrows B and C through 180°, so that they assume the position shown in FIG. 2. In this position the flats 14*a* of the locking noses 14 come into the region of the bottom surfaces 4*a*, so that the locking noses 14 no longer overlap the bottom surfaces 4*a*. The mounting bridge can then be taken off the receiver 2 in the direction D of the axes a of the blind bores 3.

The embodiments of the invention in which an exclusive property or privilege is claimed are defined as follows:

1. A mounting device for a telescopic sight on a rifle having a receiver on the barrel, comprising a mounting bridge which carries a holder for the telescopic sight and on one side, at each of the front and the rear ends, a fixed jaw and, on the opposite side, at least one movable jaw movable transverse to a longitudinal central plane running through the mounting bridge and an axis of the barrel by means of a rotatable operating handle and a threaded pin engaging in a nut, and a plurality of clamping surfaces provided on the receiver of the barrel, extending at an angle to a longitudinal central plane and on which the jaws engage in the mounted position, wherein the clamping surfaces on one side of the barrel are formed by two blind bores running substantially radially relative to the barrel axis and offset from one another in a direction of the barrel axis, and wherein opposite each said blind bore, on another side of the barrel, there is provided an approximately half-moon shaped notch, a bottom surface of the notch running in a barrel direction forming a clamping surface for the movable jaw, wherein the fixed jaws at each end of the mounting bridge each comprise a cylindrical retaining pin which fits in one of the blind bores, and wherein each fixed jaw has associated therewith a movable jaw in the form of a locking nose provided on a pivoting lever, wherein the pivoting lever is fixedly connected to a threaded pin which is axially movable in a bore in the mounting bridge running substantially tangentially to the peripheral surface of the receiver and can be screwed into a nut fixed in the mounting bridge.

2. The device according to claim 1, wherein the locking nose of the pivoting lever is substantially cylindrical and has a flat which runs parallel to the barrel axis in the released position.

3. The device according to claim 1, wherein the fixed jaws and the retaining pins are in one piece with the mounting bridge.

4. The device according to claim 1, wherein the mounting bridge has abutment surfaces on the side opposite the retaining pins, with which surfaces it bears on the receiver.

5. The device according to claim 4, wherein each fixed jaw and abutment surface are arranged on a supporting foot of the mounting bridge bearing on the receiver.

6. The device according to claim 1, wherein the axes of the blind bores make an acute angle with a plane running through the bottom surfaces.

7. The device according to claim 6, wherein the acute angle is about 50°–70°.

* * * * *